US007752786B2

(12) United States Patent
Webster et al.

(10) Patent No.: US 7,752,786 B2
(45) Date of Patent: Jul. 13, 2010

(54) AIRPORT ADVERTISING SYSTEM

(75) Inventors: Warren James Webster, Harbord (AU); Denis Rogan, Bulli (AU)

(73) Assignee: Denann Consultant Services Pty Ltd., Bulli (AU)

( * ) Notice: Subject to any disclaimer, the term of this patent is extended or adjusted under 35 U.S.C. 154(b) by 937 days.

(21) Appl. No.: 10/362,308

(22) PCT Filed: Aug. 16, 2001

(86) PCT No.: PCT/AU01/01015

§ 371 (c)(1),
(2), (4) Date: Jul. 30, 2003

(87) PCT Pub. No.: WO02/15161

PCT Pub. Date: Feb. 21, 2002

(65) Prior Publication Data

US 2004/0025385 A1 Feb. 12, 2004

(30) Foreign Application Priority Data

Aug. 16, 2000 (AU) ..... PQ 9459

(51) Int. Cl.
*G09F 21/06* (2006.01)

(52) U.S. Cl. ..... 40/217; 40/472

(58) Field of Classification Search ..... 40/217, 40/472, 524, 604

See application file for complete search history.

(56) References Cited

U.S. PATENT DOCUMENTS

| | | | | | |
|---|---|---|---|---|---|
| 1,767,804 | A | * | 6/1930 | MaClachlan | 40/472 |
| 1,984,168 | A | * | 12/1934 | Wilhelm | 40/217 |
| 2,200,533 | A | * | 5/1940 | Borregard | 40/472 |
| 3,233,352 | A | * | 2/1966 | Projector et al. | 40/541 |
| 4,424,449 | A | | 1/1984 | O'Brill | |
| 4,879,965 | A | * | 11/1989 | Valley | 116/209 |
| 5,288,163 | A | * | 2/1994 | Munson | 404/9 |
| 5,815,966 | A | | 10/1998 | Vestevich | |

FOREIGN PATENT DOCUMENTS

| | | | |
|---|---|---|---|
| CH | 689 320 | A5 | 5/1995 |
| EP | 0 479 697 | A1 | 10/1991 |
| EP | 596850 | A1 * | 5/1994 |
| FR | 2 590 060 | | 9/1985 |
| JP | 11-106685 | | 4/1999 |
| WO | WO 98/14930 | | 4/1998 |
| WO | WO 99/44840 | | 9/1999 |

* cited by examiner

*Primary Examiner*—Joanne Silbermann
(74) *Attorney, Agent, or Firm*—K&L Gates LLP

(57) ABSTRACT

The present invention relates to airport advertising. Airports are divided into the "landside" to which the general public is permitted and which includes the terminal(s), car parks etc., and the "airside" from which the public is excluded and which includes the runways, taxiing area, apron etc. Billboards (7) which are substantially flush with the ground surface are located in the airside preferably adjacent the runways (2, 3, 4). The billboards (7) are preferably between the runway extremities and a take off/touch down zone (5). Alternatively the billboards are adjacent taxiways or taxiing areas. The billboards can be provided with movable images and/or interior lighting. A typical billboard size is 50 meters×50 meters (0.25 hectares).

23 Claims, 2 Drawing Sheets

AIRPORT ADVERTISING SYSTEM

FIELD OF THE INVENTION

The present invention relates to airports and, in particular, to a system of displaying advertising to aircraft passengers during take-off and/or landing of the aircraft from the airport.

BACKGROUND ART

Airports are by definition dividend into two zones, namely the "airside" and the "landside". The airside is the area from which members of the public are excluded and includes the runways, taxiing areas and apron. The "landside" is the remainder of the airport to which the general public is permitted free access and egress. This includes the terminals, car parks, taxi rank, etc.

It is well known that aircraft passengers represent a lucrative market and the provision of advertising to aircraft passengers in aircraft terminals is a well established business which enjoys a large turnover. Normally such display advertising takes the form of large vertical billboards positioned on the walls of the interior of the airport terminal. However, this advertising is restricted to the landside. As a consequence, this advertising is only able to be seen by the aircraft passengers prior to embarkation and after disembarkation and is unable to be seen during flight.

OBJECT OF THE INVENTION

The object of the present invention is to extend the availability of advertising to enable advertising to be displayed to aircraft passengers during take-off and/or landing and/or taxiing and thereby create a new advertising market. In particular, the invention enables advertising to be displayed at locations in the airside.

SUMMARY OF THE INVENTION

In accordance with a first aspect of the present invention there is disclosed a substantially horizontal billboard being substantially flush with a ground surface and being dimensioned to be visible to aircraft passengers during take-off and/or landing and/or taxiing of the aircraft. Preferably the billboard is located within the airside.

In accordance with a second aspect of the present invention there is disclosed a method of displaying advertising to aircraft passengers within an aircraft whilst in flight or taxiing within an airport airside, said method comprising the step of locating a substantially horizontal billboard at a location within the airside, said billboard being substantially flush with a ground surface and being dimensioned to be visible to aircraft passengers during take-off and/or landing and/or taxiing of the aircraft. The preferred location is alongside an airport runway at a distal end of said runway beyond a touch-down/lift-off zone of the runway.

BRIEF DESCRIPTION OF THE DRAWINGS

Several embodiments of the present invention will now be described with reference to the drawings in which.

DETAILED DESCRIPTION

Figure 1:
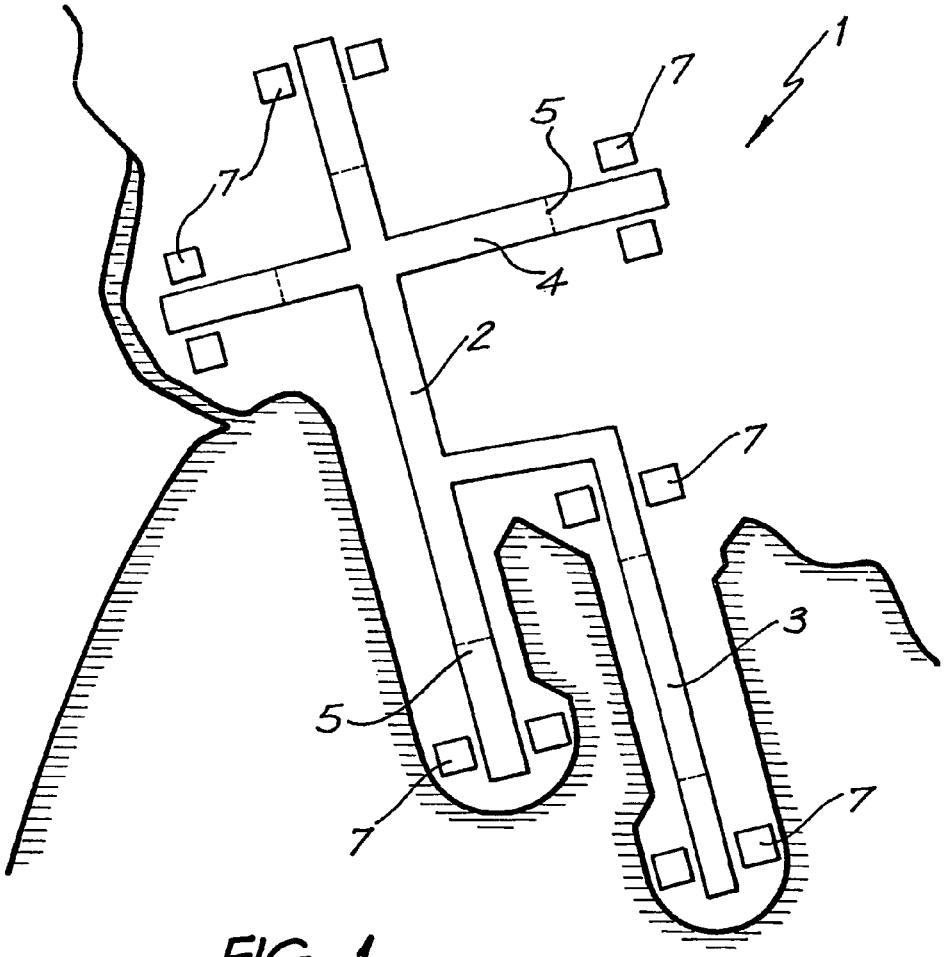
FIG. 1 is a plan view of Sydney's Kingsford-Smith Airport showing the locations of the three runways.

As seen in FIG. 1, Sydney's Kingsford-Smith Airport 1 has two north-south runways 2, 3 and an east-west runway 4 within the airside. Each runway has a central zone intermediate two opposite distal ends. Intermediate the central portion and the distal ends is a take-off/touch-down zone 5 indicated by dotted lines in FIG. 1. That is to say, aircraft taking off approach the distal end of the runway and are airborne at or about the zone 5 whilst aircraft coming in to land approach the central zone of the runway and have landed by the time they reach the zone 5.

In accordance with a first embodiment, positioned alongside each of the runways 2, 3, 4 and between the distal end of the runway and the adjacent zone 5 is a large, substantially horizontal billboard 7. In the embodiment illustrated in FIG. 1 each of the three runways has four billboards 7 so there are twelve billboards 7 in total.

Each of the billboards 7 has a dimension of approximately fifty meters by fifty meters and is therefore approximately ¼ hectare in surface area. Such a size billboard is easily able to be seen by aircraft passengers immediately prior to landing or immediately after taking off.

In general the area alongside runways is grassed and must be generally free of obstructions in order that there not be a collision with an obstruction should the aircraft happen to leave the runway in an unintended direction. Most such grassed areas are regularly mowed, however, sometimes they are fenced off and grazed. In all cases the general public is denied access to the grassed areas. In order not to constitute an obstruction, the billboards 7 should preferably be both substantially horizontal and also be mounted close to the ground. In its simplest form, the billboard 7 could simply be formed from the grass alongside the runway and the indicium or indicia which go to make up the advertising can simply be painted on to the grass or the grass be dyed. However, it is thought that this is generally unsatisfactory since the grassed areas alongside airport runways are generally not very smooth and substantial upkeep is required for such a site.

Therefore a second embodiment is to form the indicia on a low level prepared surface other than grass. Examples of such prepared surfaces include spray sealed rolled profiles, light construction asphalt, or concrete. The indicia are painted onto the prepared surface. Such prepared surfaces incur a capital cost but reduce the maintenance costs such as grass mowing.

Figure 2:
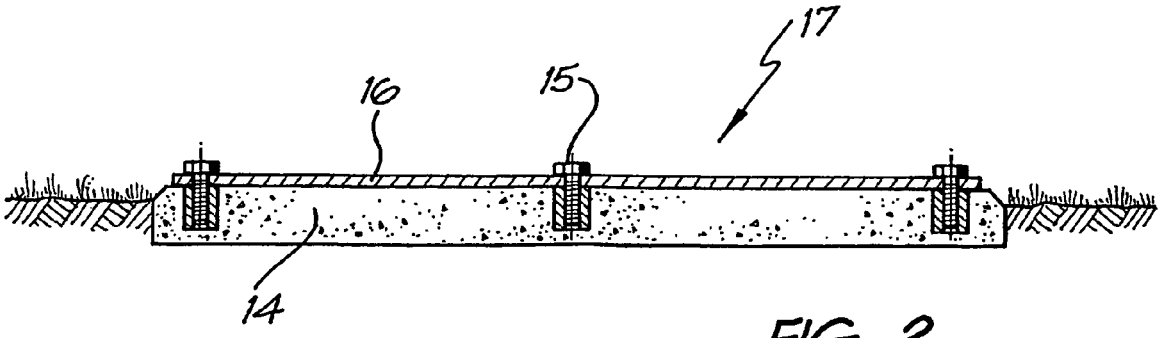
FIG. 2 is a transverse vertical cross-section through a horizontal billboard in accordance with one embodiment of the present invention.

A third, and more preferred embodiment is that illustrated in FIG. 2 where a billboard 17 is formed from a rigid sheet 16 which is anchored by bolts 15 into a cementitious pad 14 formed from concrete or asphalt. In this way the sheet 16 is able to be provided with bright colouring of a durable nature and therefore the upkeep of the billboard 17 is minimal.

It is apparent that the land surface in FIG. 2 is substantially level and therefore so to is the sheet 16. However, if the land surface slopes then so too will the sheet 16. Thus the sheet 16 may be regarded as being substantially flush with the land surface.

Figure 3:
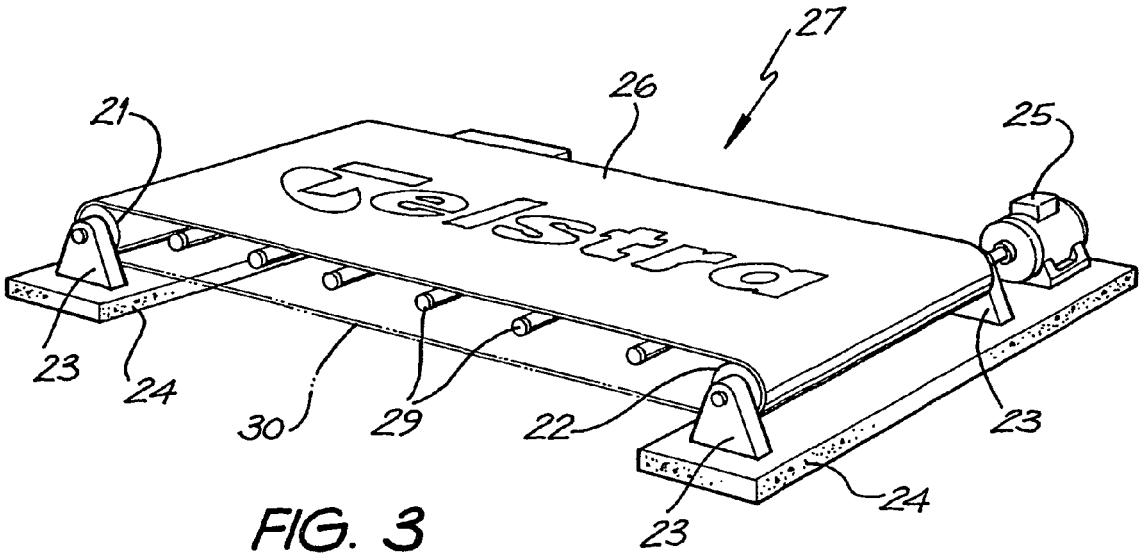
FIG. 3 is a perspective view of a horizontal billboard in accordance with another embodiment of the present invention.

In a still further embodiment as illustrated in FIG. 3, the billboard 27 is formed from a flexible sheet 26 which extends between two rollers 21 and 22 which are mounted in journals 23 which are in turn supported by a cementitious pad 24. A motor 25 enables the roller 21 to be rotated in either direction.

The flexible sheet 26 carries an advertising sign. If desired, the advertising sign can be back illuminated by means of elongate light fittings 29 positioned under the sheet 26 at spaced apart locations.

As indicated by dotted lines in FIG. 3, if desired the flexible sheet 26 can take the form of an endless loop 30 which enables two advertising signs to be alternatively displayed in a regular automated fashion. Alternatively, the flexible sheet 26 can consist of only a single sign in which case the sheet 26 is wrapped around each of the rollers 21, 22 only by a small number of turns or even a fraction of a turn. In a further possible arrangement, the flexible sheet 26 can be very long and can be rolled from one roller 21 to the other roller 22, and then reversed. Such an arrangement enables a long sequence of advertisements to be displayed in turn, and the sequence then reversed.

Figure 4:
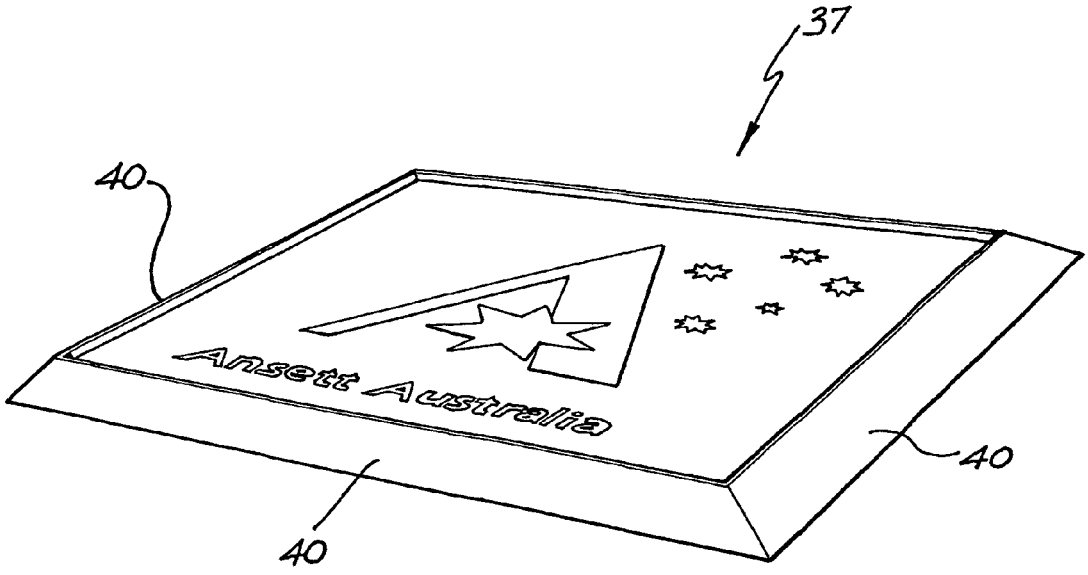
FIG. 4 is a view similar to FIG. 3 but showing a further embodiment of the present invention having a peripheral skirt.

FIG. 4 illustrates a still further embodiment of a billboard 37 which is essentially the same as in FIG. 3 but is provided with a peripheral skirt 40 which prevents wind entering under the tensioned flexible sheet which forms the display surface of the billboard 37.

The height of the billboards 17, 27, 37 above the ground is typically less than one meter so there are several orders of magnitude difference between the height of the billboard above the ground and the length of an edge of the billboard.

The foregoing describes only some embodiments of the present invention and modifications, obvious to those skilled in the art, can be made thereto without departing from the scope of the present invention. For example, the rigid sheet 16 can be formed from a number of individual flush and abutting smaller sheets. Furthermore, the sheet 16 can be mounted at an inclined angle, preferably falling towards the adjacent runway, in order to both enhance its visibility from the air and permit run-off of rainwater from the sheet 16. In some instances the airside can include sloping surfaces, or even man made hills, on which the billboard(s) can be located generally substantially flush with the sloping surface. Generally such slopes would have a slope angle of approximately 60° or less—being the slump angle of soil or the scree angle of weathered debris.

In addition to being located as indicated in FIG. 1, the billboards 7 can also be located adjacent taxiways (taxiing runways which inter-connect the airport terminal(s) with the take off and landing runways 2, 3, and 4). In this way passengers can see advertising whilst taxiing and, in particular, whilst delayed on taxiways waiting for the take off runway to be cleared for take off.

The term "comprising" has used herein is used in the inclusive sense of "including" or "having" and not in the exclusive sense of "consisting only of".

The invention claimed is:

1. A substantially horizontal billboard being substantially flush with a ground surface and being dimensioned to be visible to aircraft passengers during take-off, landing or taxiing of an aircraft wherein the billboard is located within the airside of an airport, wherein said airside comprises at least one runway and at least one taxiway and wherein said billboard is located adjacent to and positioned a distance away from said runway or taxiway such that said billboard is positioned substantially parallel to the aircraft as the aircraft moves past said billboard during take-off and landing.

2. The billboard as defined in claim 1 and located alongside the airport runway and adjacent a distal end said runway beyond a touchdown/lift-off zone of said runway.

3. The billboard as defined in claim 2 and comprising at least one indicium formed on, or adhered to, grass alongside said runway.

4. The billboard as defined in claim 3 wherein said indicium is formed by painting and dyeing said grass.

5. The billboard as defined in claim 1 and located adjacent a taxiway of the airport.

6. The billboard as defined in claim 1 and comprising at least one indicium formed on, or adhered to, a prepared surface of said airside.

7. The billboard as defined in claim 6 wherein said prepared surface is selected from the group consisting of spray sealed rolled profiles, light construction asphalt and light construction concrete.

8. The billboard as defined in claim 1 comprising a layer of sheet material mounted closely adjacent the ground and anchoring means interconnecting said sheet material and said ground to prevent said sheet material being dislodged from its mounted position.

9. The billboard as defined in claim 8 wherein said sheet material is directly anchored to said ground.

10. The billboard as defined in claim 8 wherein said sheet material is substantially rigid and is bolted to a pad of hardened cementitious material formed substantially flush with said ground.

11. the billboard as defined in claim 1 comprising a pair of substantially parallel rollers, means to mount said rollers closely adjacent the ground, a pliant sheet extending around and between said rollers, and means to rotate at least one of said rollers and thereby tension said sheet.

12. The billboard as defined in claim 11 wherein said sheet extends in an endless loop between said rollers.

13. The billboard as defined in claim 11 and having a peripheral skirt which substantially excludes wind from beneath said pliant sheets.

14. The billboard as defined in any one of claims 11 and having lighting means positioned below said sheet.

15. A method of displaying advertising to aircraft passengers within an aircraft while the aircraft is within an airport airside, said method comprising the step of locating a substantially horizontal billboard at a location within the airside, wherein said airside comprises at least one runway and at least one taxiway and wherein said billboard is located adjacent to and positioned a distance away from said runway or taxiway, said billboard being substantially flush with a ground surface and being dimensioned to be visible to aircraft passengers during at least one event selected from the group consisting of take-off, landing and taxiing of the aircraft, and wherein the billboard is positioned substantially parallel to the aircraft as the aircraft moves past said billboard during take-off and landing.

16. The method as defined in claim 15 wherein said location is alongside an airport runway adjacent a distal end of said runway beyond a touch-down/lift-off zone of said runway.

17. The method as claimed in claim 15 wherein said location is adjacent a taxiing route of said aircraft.

18. The method as defined in claim 15 including the further step of repeatedly changing the advertising displayed.

19. The method defined in claim 15 including the further step of illuminating the billboard.

20. A horizontal billboard located on the airside of an airport, wherein said airside comprises at least one runway and at least one taxiway and wherein said billboard is located adjacent to and positioned a distance away from said runway or taxiway, said billboard being substantially flush with a ground surface and positioned and arranged to be visible to aircraft passengers from an aircraft on an airside of an airport, wherein the billboard is positioned substantially parallel to the aircraft as the aircraft moves past said billboard during take-off and landing.

21. The billboard as defined in claim 20 comprising at least one indicium formed on, or adhered to, grass alongside said runway.

22. The billboard as defined in claim 20 comprising a layer of sheet material mounted closely adjacent the ground and anchoring means interconnecting said sheet material and said ground to prevent said sheet material being dislodged from its mounted position.

23. The billboard as defined in claim 20 comprising a pair of substantially parallel rollers, means to mount said rollers closely adjacent the ground, a pliant sheet extending around and between said rollers, and means to rotate at least of said rollers and thereby tension said sheet.

* * * * *